United States Patent [19]
Bontempi
[11] 4,132,144
[45] Jan. 2, 1979

[54] VOLUME ADJUSTER FOR AIR OPERATED MUSICAL INSTRUMENTS

[75] Inventor: Paolo Bontempi, Montelupone (Macerata), Italy

[73] Assignee: Comus S.p.A., Potenza Picena (Macerata), Italy

[21] Appl. No.: 742,947

[22] Filed: Nov. 18, 1976

[30] Foreign Application Priority Data

Dec. 10, 1975 [IT] Italy ..... 22856 B/75

[51] Int. Cl.² ..... G10B 3/04
[52] U.S. Cl. ..... 84/359; 84/362
[58] Field of Search ..... 84/330, 335, 355–356, 84/359–363, 375

[56] References Cited

U.S. PATENT DOCUMENTS 3,063,326 11/1962 Magnew ..... 84/351
3,927,596 12/1975 Martin et al. ..... 84/355

FOREIGN PATENT DOCUMENTS 843790 8/1960 United Kingdom ..... 84/355

*Primary Examiner*—Lawrence R. Franklin
*Attorney, Agent, or Firm*—Sughrue, Rothwell, Mion, Zinn and Macpeak

[57] ABSTRACT

A volume adjuster for an air operated instrument such as an electric organ includes a shutter valve which can be slid across the delivery duct of the instrument blower by means of a slider movable in a linear guide on a flat keyboard surround so as to permit fine adjustment of the volume.

4 Claims, 3 Drawing Figures

VOLUME ADJUSTER FOR AIR OPERATED MUSICAL INSTRUMENTS

The present invention relates to a volume adjuster for air operated musical instruments such as electric organs and the like having a body equipped with a keyboard, a reed chamber extending below and parallel to the keyboard and a blower arranged to supply air to the reed chamber.

It is known to provide for adjustment of the volume of the sounds generated by an electric organ of the aforesaid type by controlling the air delivery from the blower, using a control mechanism acting upon a valve in a delivery port connected to the outlet of the blower. Such a mechanism generally includes a number of levers and mechanical linkages operable by a control located outside of the body of the instrument and generally positioned out of the plane of the instrument keyboard.

Such a volume adjustment mechanism, although widely used, has various disadvantages, among which the most serious is the inevitable inertia with which the levers and mechanical linkages of the mechanism oppose any movement required to effect operation of the valve controlling the delivery of the blower. A further disadvantage is the difficulty of regulating precisely the degree of opening or closing of the valve, particularly after the organ has been in use for some time, in consequence of which the volume adjustment may in practice have only two settings, namely full volume and minimum volume. A further disadvantage is that because of the number of levers and connections in the mechanism, failure can easily occur due to breakages, disconnections or distortions of the levers or linkages.

Yet another not inconsiderable disadvantage is the laborious and hence uneconomical construction and assembly of a volume adjustment mechanism of the mechanical type.

The main object of the present invention is to provide a volume adjuster for air-operated musical instruments, for example electric organs and the like, having structural and functional characteristics which avoid the above-mentioned disadvantages of the prior art volume adjustment mechanism, as well as being simple, reliable and easily operated.

According to the present invention there is provided a volume adjuster for air-operated musical instruments, such as electric organs and the like, having a main body equipped with a keyboard, a reed chamber extending below, and parallel to the keyboard and a blower arranged to supply air to the reed chamber through a delivery duct, characterised in that the volume adjuster includes an elongate slider in a rectilinear guide in a flat keyboard surround, and a valve member affixed to the said slider and movable thereby transversely across the said delivery duct between positions of minimum and maximum obstruction of air flow through the said delivery duct.

The invention will be further described, by way of non-limiting example, with reference to the accompanying drawings, in which.

Figure 1:
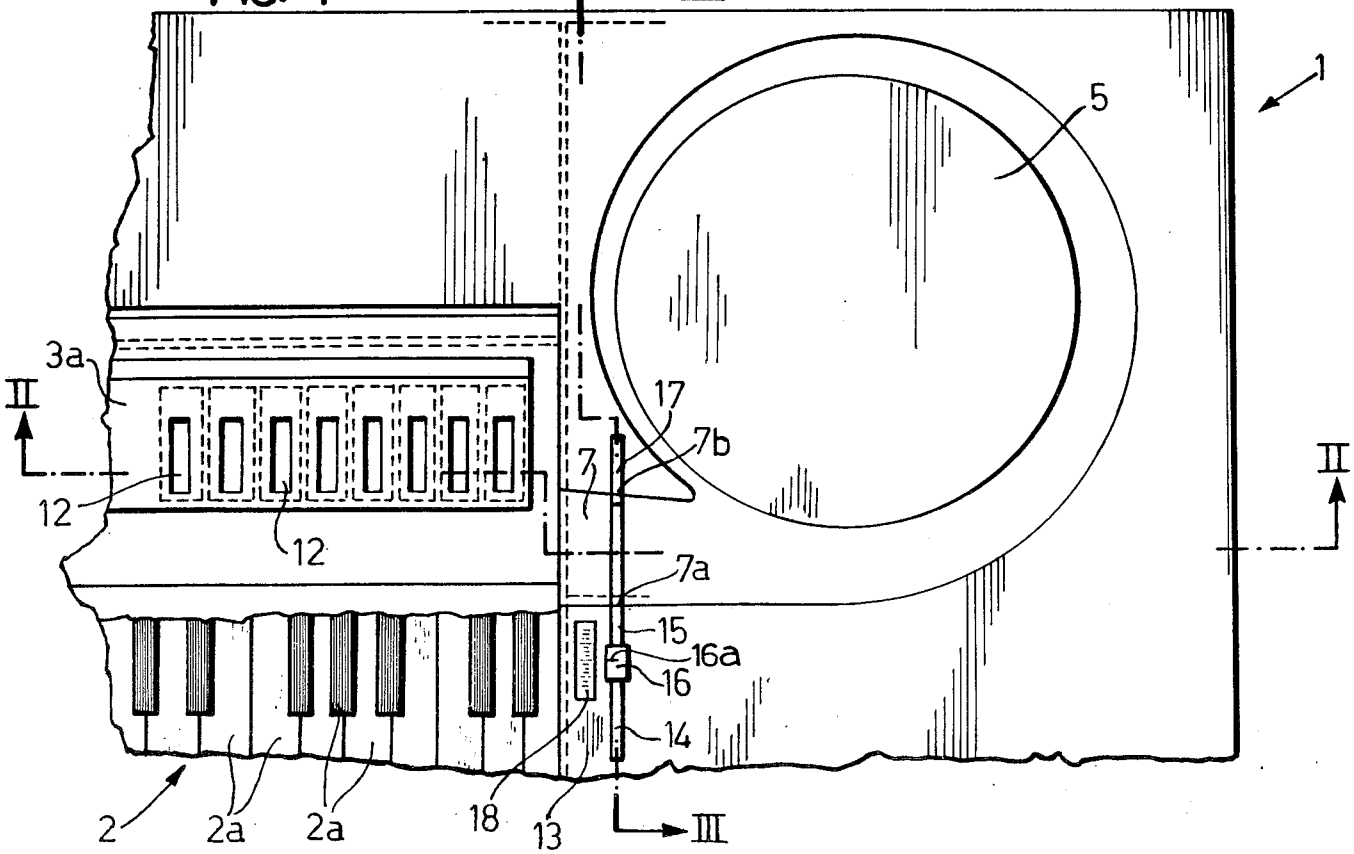
FIG. 1 is a partially broken away plan view of part of the main body of an electric organ incorporating a volume adjuster according to one embodiment of the invention.
Figure 2:
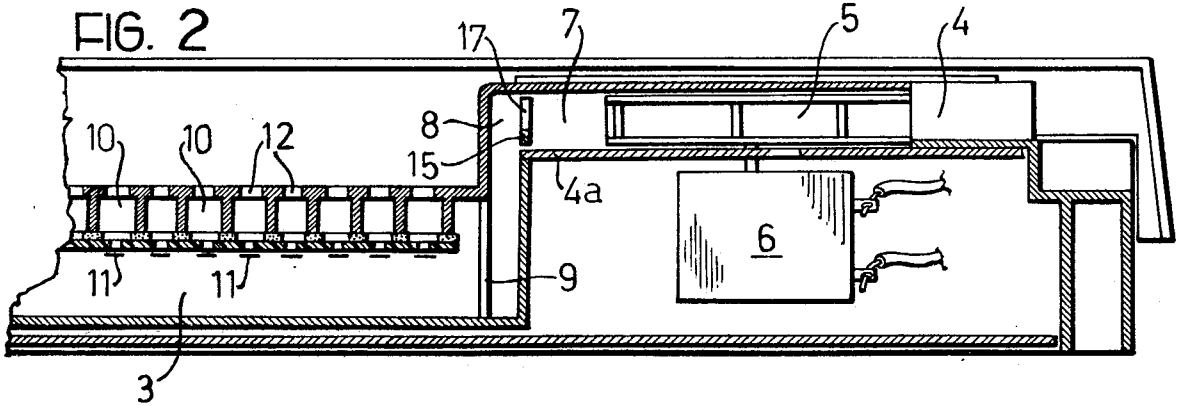
FIG. 2 is a section taken on line II—II of FIG. 1.

Referring to the drawings, there is shown part of the main body 1 of an electric organ equipped with a keyboard 2, a reed chamber 3 extending below and parallel to the keyboard 2, and a further chamber 4 within the said body 1 spaced laterally from and disposed above the reed chamber 3.

The chamber 4 has a bottom wall 4*a* which is coplanar with a flat keyboard surround 13. Within the chamber 3 there is arranged a centrifugal blower 5 driven by an electric motor 6. The blower 5 has a delivery duct 7 which communicates with the reed chamber 3 via a vertical duct 8 made in the said main body 1 and via an opening 9 formed in an end wall of said chamber 3.

Within the reed chamber 3 there are formed, in a known way, a number of resonance chambers 10, with each of which a resiliently flexible reed 11 cooperates. Each resonance chamber 10 communicates with the outside of the chamber 3 through a respective outlet aperture 12 in an upper wall 3*a* of the aforesaid reed chamber 3. The keyboard 2 comprises a number of conventionally mounted keys 2*a* which individually control valves (not shown) which normally close the respective outlet apertures 12. Each valve can be opened by depression of the respective key 2*a* to permit air flow from the reed chamber 3 through the respective resonance chamber 10, causing vibration of the associated reed 11.

Figure 3:
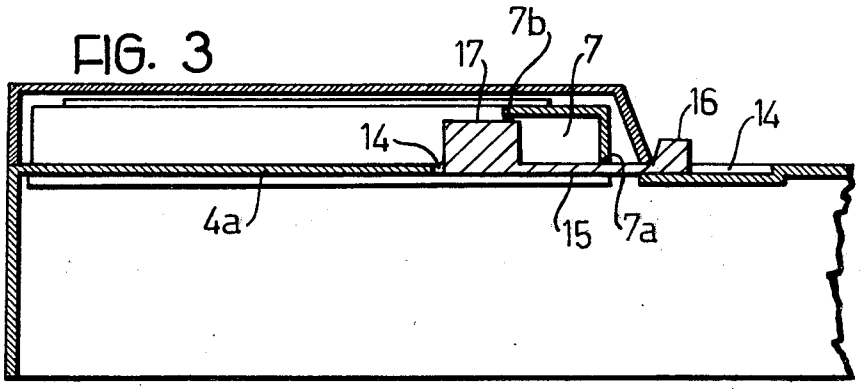
FIG. 3 is a section taken on line III—III of FIG. 1.

The bottom wall 4*a* of the chamber 4 is formed with a groove 14 extending laterally with respect to the keyboard 2 and parallel to the keys 2*a*. An elongate slider 15 is slidable in the said groove 14 and is formed with a finger-operable key 16 at one end which is adjacent the flat keyboard surround 13 and accessible therefrom. The other end of the slider 15 carries a valve shutter plate 17 which passes through slots 7*a*, 7*b* made in opposite walls of the blower delivery duct 7. The valve shutter plate 17 has a shape and transverse dimensions corresponding to the shape and transverse dimensions of the said delivery duct 7, whilst the length of the slider 15 is such it can be moved from a position in which the shutter plate 17 does not interfere with air flow through the delivery duct 7 (FIG. 3) to a position in which the shutter plate 17 completely closes the said delivery duct 7.

Upon the flat keyboard surround 13 there is affixed by cutting, sticking or other means, a graduated scale 18 in a position alongside the groove 14. The finger-key 16 of the slide 15 carries a mark of indicium 16*a* which cooperates with the graduated scale 18.

By movement of the slider 15 and thus of the valve shutter plate 17 it is possible to shut off completely the air delivery from the blower 5, or to regulate the air flow through the blower delivery duct 7, according to the desired volume of the sound generated by the electric organ. The degree of shutting-off of the duct 7 by the valve shutter plate 17 can be pre-fixed and preselected, by bringing the mark 16*a* on the key 16 into coincidence with a pre-fixed and pre-selected mark on the graduated scale 18.

What is claimed is:

1. In an air-operated musical instrument, such as an electric organ, having a main body equipped with a keyboard, a flat keyboard surround adjacent the keyboard, a reed chamber extending below and parallel to the keyboard, a blower and a delivery duct arranged to deliver air from the blower to the reed chamber, the improvement which consists of volume adjusting means comprising an elongate slider movable in a rectilinear guide in the flat keyboard surround, an elongate slider movable in said guide, and a valve member affixed to said slider and movable thereby transversely across said delivery duct between positions of minimum and maximum obstruction of air flow through the said delivery duct.

2. The improvement defined in claim 1, wherein the valve member is movable between a fully open position in which the air flow through the delivery duct in unobstructed and a fully closed position in which said duct is completely obstructed.

3. The improvement defined in claim 1, wherein said guide extends laterally with respect to the said keyboard in a direction parallel to the keys of the keyboard.

4. The improvement defined in claim 1, wherein said slider is provided at one end with a finger-key accessible from the outside of the said main body adjacent said keyboard surround.

* * * * *